US009161605B2

(12) United States Patent
Kim

(10) Patent No.: US 9,161,605 B2
(45) Date of Patent: Oct. 20, 2015

(54) ROTARY PUMPING TYPE COSMETIC CONTAINER

(71) Applicant: YONWOO CO., LTD., Incheon (KR)

(72) Inventor: Sung-Hwan Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 105 days.

(21) Appl. No.: 14/059,946

(22) Filed: Oct. 22, 2013

(65) Prior Publication Data

US 2015/0108173 A1 Apr. 23, 2015

(51) Int. Cl.

| | |
|---|---|
| ***A45D 34/04*** | (2006.01) |
| ***A45D 40/26*** | (2006.01) |
| *B05B 11/00* | (2006.01) |
| *B05C 17/00* | (2006.01) |

(52) U.S. Cl.

CPC ..... *A45D 34/041* (2013.01); *A45D 34/042* (2013.01); *A45D 40/261* (2013.01); *A45D 40/262* (2013.01); *B05B 11/0048* (2013.01); *B05B 11/3015* (2013.01); *B05B 11/3025* (2013.01); *A45D 34/04* (2013.01); *A45D 2200/054* (2013.01); *B05B 11/0032* (2013.01); *B05B 11/303* (2013.01); *B05B 11/3032* (2013.01); *B05C 17/002* (2013.01)

(58) Field of Classification Search

CPC .... A45D 34/04; A45D 34/041; B05C 17/002; B05B 11/303; B05B 11/3032; B05B 11/3011; B05B 11/3052

USPC ..... 222/383.2, 256, 207; 401/188 R

See application file for complete search history.

(56) References Cited

U.S. PATENT DOCUMENTS

| | | | | |
|---|---|---|---|---|
| 6,533,482 | B1 * | 3/2003 | Byun | 401/180 |
| 7,101,107 | B1 * | 9/2006 | Byun | 401/286 |
| 7,201,526 | B2 * | 4/2007 | Tani | 401/266 |
| 7,731,440 | B2 * | 6/2010 | Tani | 401/75 |
| 7,980,777 | B2 * | 7/2011 | Kennedy et al. | 401/188 R |

* cited by examiner

*Primary Examiner* — Frederick C Nicolas

(74) *Attorney, Agent, or Firm* — IPLA P.A.; James E. Bame

(57) ABSTRACT

The rotary pumping type cosmetic container is provided, which makes it possible to easily discharge a certain amount of contents by rotating a rotation member in such a way to perform a pumping operation of a pumping member as a guide protrusion of a stem moves along a slanted surface of a bent portion of an inner side of a rotation member when a rotation member rotates.

6 Claims, 5 Drawing Sheets

ROTARY PUMPING TYPE COSMETIC CONTAINER

BACKGROUND

The present invention relates to a rotary pumping type cosmetic container, and more particularly to a rotary pumping type cosmetic container which makes it possible to easily discharge a certain amount of contents by rotating a rotation member in such a way to perform a pumping operation of a pumping member as a guide protrusion of a stem moves along a slanted surface of a bent portion of an inner side of a rotation member when a rotation member rotates.

A conventional pumping type cosmetic container designed to discharge contents with the aid of a pumping member comprises a container body for storing contents, a pumping member for performing pumping operations as it is engaged to the top of the container body, and a button member which is provided at the top of the pumping member and performs a pumping operation with the aid of a user's pressurization and has a discharge hole though which to discharge contents.

The above described pumping cosmetic container has features in that when a user pressurizes the button member, the pressure is directly transferred to the pumping member, so the pumping member operates, and the contents stored in the container body is discharged outside through the discharge hole. In terms of the manufacture of the pumping type cosmetic container, the pumping member operates as the button member of the top is pressurized. In this case, the button member may be inclined in one direction and may be pressurized, so the discharging amount of the content may change depending on the pressurizing position of the button member, whereby it is impossible to discharge a constant amount of contents.

So as to improve the above mentioned problems, there is introduced a pumping type cosmetic container in which the operations of the pumping member are conducted as the button provided at a side surface ascends or descends. Hence, many pumping type cosmetic containers capable of discharging contents through various kinds of pumping structures are being newly developed.

SUMMARY OF THE INVENTION

Accordingly, it is an object of the present invention to provide a rotary pumping type cosmetic container which improves the above mentioned problems. It is another object of the present invention to provide a rotary pumping type cosmetic container which makes it possible to easily discharge a certain amount of contents by rotating a rotation member in such a way to perform a pumping operation of a pumping member as a guide protrusion of a stem moves along a slanted surface of a bent portion of an inner side of a rotation member when a rotation member rotates.

To achieve the above objects, there is provided a rotary pumping type cosmetic container which comprises a container body which stores contents; a support member which is engaged to the top of the container body and is hollow and supports a pumping member; a pumping member which is engaged to the support member and performs a pumping operation for the contents stored in the container body to be discharged outside and comprise a cylinder which is engaged to the support body; a piston rod which ascends or descends in the interior of the cylinder; a stem which is engaged to the piston rod and has a guide protrusion which protrudes from an outer side of the top; and an elastic member which is installed at the bottom of the stem and provides an elastic force in an upward direction; an ascending and descending guide member which is engaged to the support member and has a vertical guide groove, into which the guide protrusion is inserted, for thereby preventing the rotation of the stem and guiding the ascending and descending operations; a rotation member which is engaged rotatable at the top of the container body and surrounds the support member and at the top of which rotation member is formed a discharge potion for discharging contents, at the inner surface of which is formed a bent portion surrounding the inner surface for thereby guiding the upward and downward movements of the guide protrusion; and a discharge means which is engaged to the discharge portion of the rotation member for thereby discharging contents.

In addition, the bent portion is alternately formed in upward and downward directions and surrounds the inner surface of the rotation member.

In addition, at a flat mounting portion of the upper most portion of the bent portion formed at the top is provided a fixing protrusion which fixes the guide protrusion.

In addition, to the inner side of the top of the rotation member is engaged a leakage prevention part which is inserted into the top of the stem and prevents leak of the contents which moves in an upward direction.

In addition, the leakage prevention part comprises a leakage prevention rod which is inserted into the top of the stem and guides the contents to move in an upward direction, the bottom of which leakage prevention rod coming into close contact with an inner wall of the stem; and a leakage prevention cap which is engaged surrounding the top of the leakage prevention rod and is mounted at the inner side of the top of the rotation member and supports the leakage prevention rod.

In addition, the leakage prevention rod comprises a content moving hole at a central portion in a longitudinal direction, the bottom of which leakage prevention rod being formed in a piston shape and coming into a close contact with an inner wall of the stem.

The present invention makes it possible to easily discharge a certain amount of contents by rotating a rotation member in such a way to perform a pumping operation of a pumping member as a guide protrusion of a stem moves along a slanted surface of a bent portion of an inner side of a rotation member when a rotation member rotates.

In addition, since a pumping operation is conducted as a guide protrusion moves along an inclined protrusion of a bent portion alternately formed surrounding an inner surface of a rotation member, a pumping operation can be conducted based on a bidirectional rotation irrespective of operational direction, as a result of which a user can easily use the product.

DETAILED DESCRIPTION OF THE INVENTION

Figure 1:
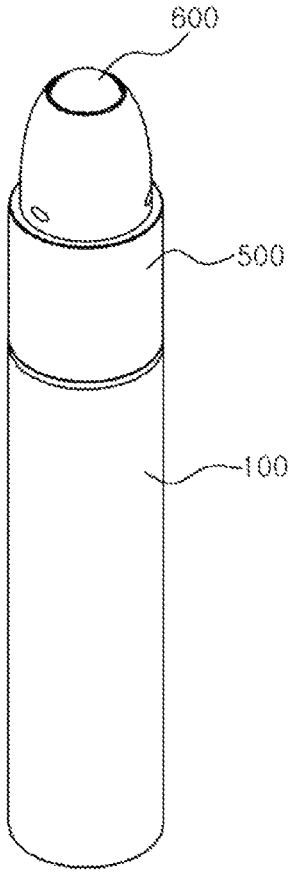
FIG. 1 is a perspective view illustrating an engaged construction of a rotary pumping type cosmetic container according to a preferred embodiment of the present invention.

The preferred embodiment of the present invention will be described with reference to the accompanying drawings. It is noted that the same reference numerals shown in each drawing mean same elements.

Figure 2:
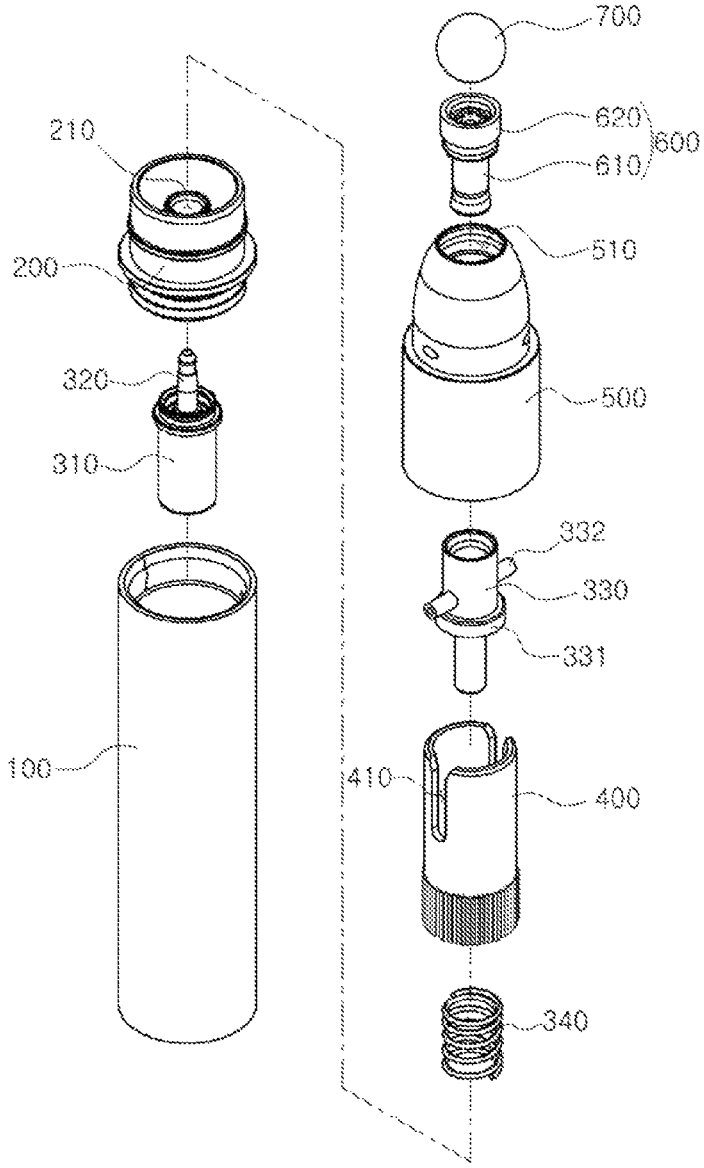
FIG. 2 is a perspective view illustrating a disassembled construction of a rotary pumping type cosmetic container according to a preferred embodiment of the present invention.
Figure 3:
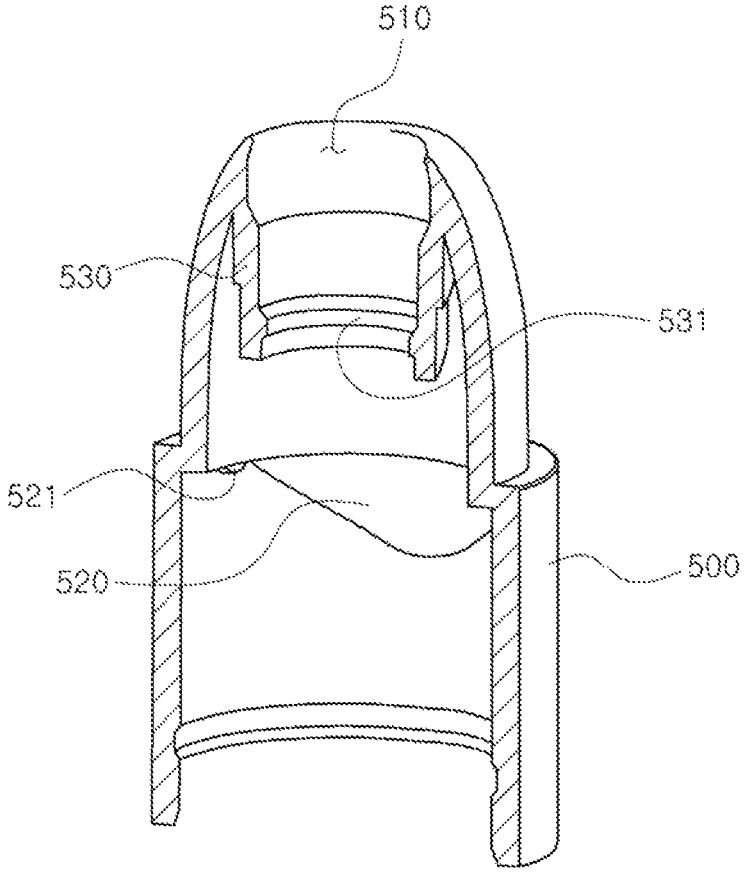
FIG. 3 is a cross sectional view illustrating a construction of a rotation member of a rotary pumping type cosmetic container according to a preferred embodiment of the present invention.

FIG. 1 is a perspective view illustrating an engaged construction of a rotary pumping type cosmetic container according to a preferred embodiment of the present invention. FIG. 2 is a perspective view illustrating a disassembled construction of a rotary pumping type cosmetic container according to a preferred embodiment of the present invention. FIG. 3 is a cross sectional perspective view illustrating a construction of a rotation member of a rotary pumping type cosmetic container according to a preferred embodiment of the present invention.

Figure 4:
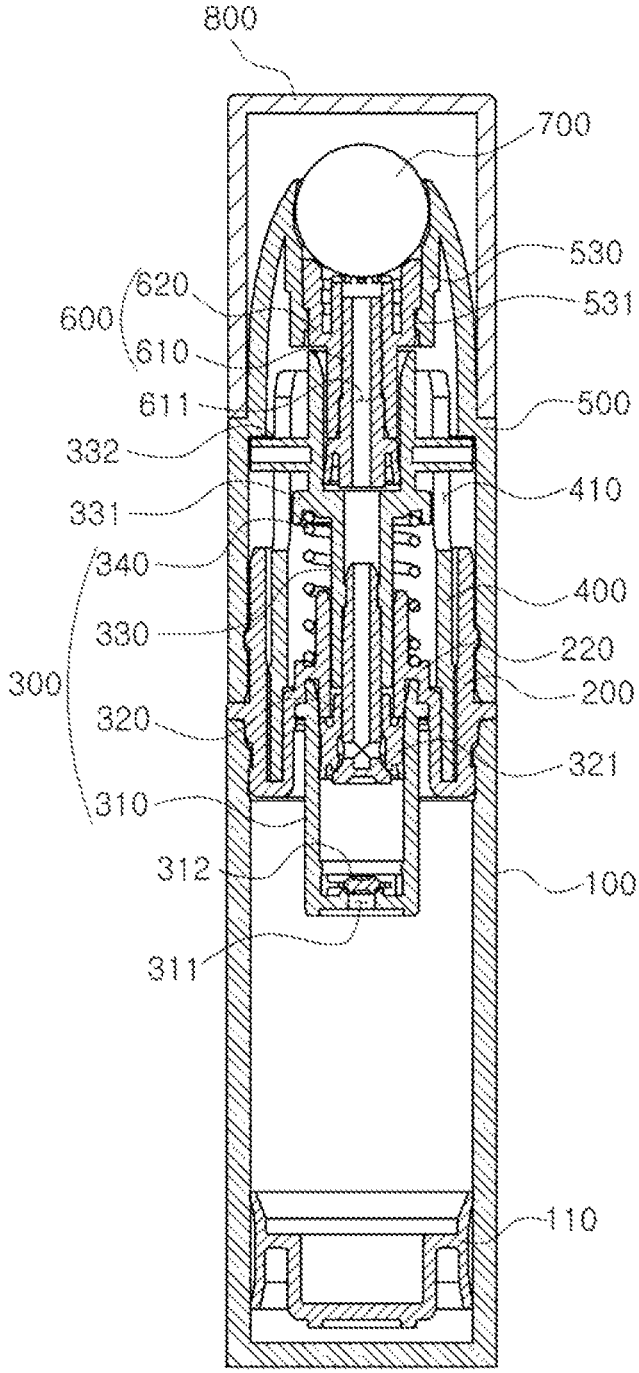
FIGS. 4 and 5 are cross sectional views illustrating a construction of a rotary pumping type cosmetic container according to a preferred embodiment of the present invention.
Figure 5:
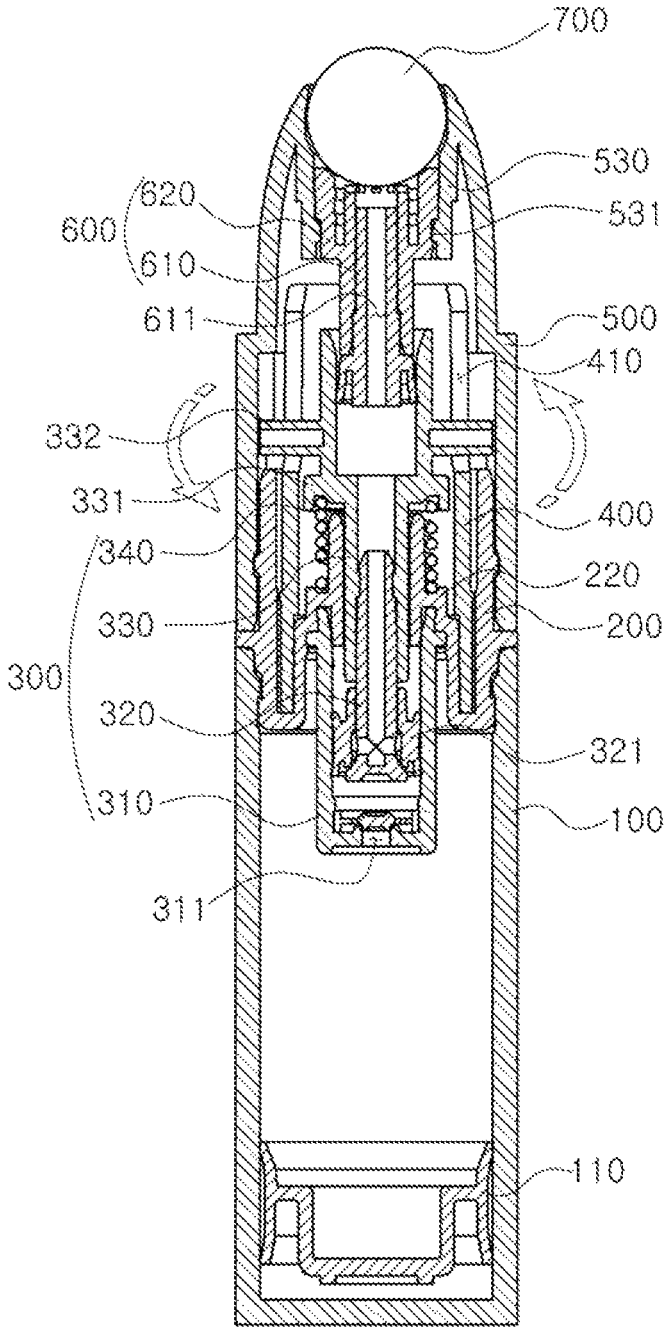
Figure 6A:
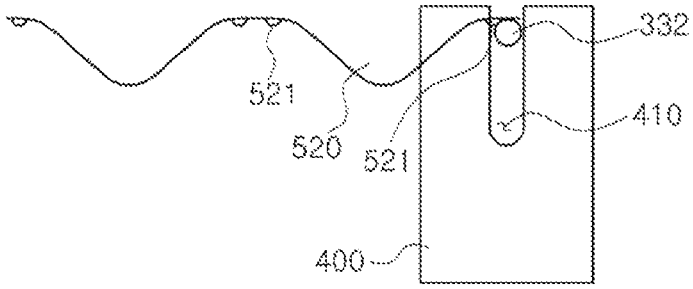
FIGS. 6*a*-6*c* are views for explaining an operation state of a rotary pumping type cosmetic container according to a preferred embodiment of the present invention.
Figure 6B:
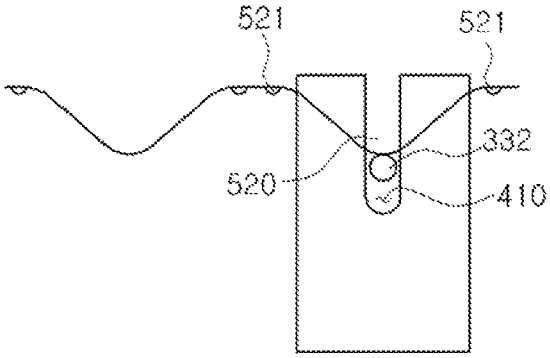
Figure 6C:
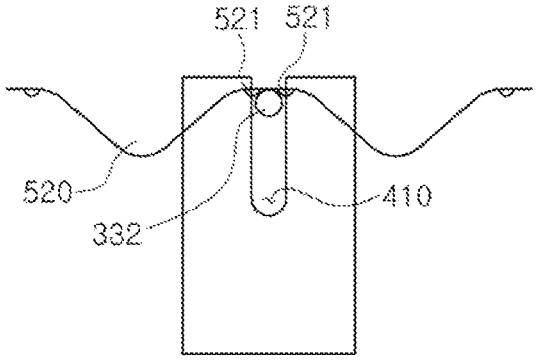

FIGS. 4 and 5 are cross sectional views illustrating a construction of a rotary pumping type cosmetic container according to a preferred embodiment of the present invention. FIGS. 6*a*-6*c* are views for explaining an operation state of a rotary pumping type cosmetic container according to a preferred embodiment of the present invention.

As best seen in FIGS. 1 to 6, the rotary type pumping cosmetic container according to a preferred embodiment of the present invention comprises a container body 100, a support member 200, a pumping member 300, an ascending and descending guide member 400 and a rotation member 500.

The container body 100 stores contents and has a piston 110 which ascends when a user uses contents.

The support member 200 is engaged to the top of the container body 100 for thereby supporting the pumping member 300 and has a hollow part 210 for the sake of insertion of the piston rod 320 and the stem 330. At an outer side of the hollow part 210 is provided a spring mounting part 220 for the elastic member 340 to be mounted for the sake of a pumping operation of the pumping member 300.

The pumping member 300 is engaged to the support member 200 and performs a pumping operation so that the contents stored in the container body 100 to be discharged outside, and comprises a cylinder 310, a piston rod 320, a stem 330 and an elastic member 340.

The cylinder 310 is engaged to the bottom of the support member 200, at the bottom of which cylinder is provided a suction through hole 311 into which contents are inputted. At the top of the suction through hole 311 is provided a check valve 312 for allowing the fluid to flow only in a suction direction.

The piston rod 320 is engaged to the inner side of the stem 330 and ascends and descends in the interior of the cylinder 310 as the stem 330 ascends and descends. At the center shaft of the piston rod is formed a space the upper side of which is open and the lower side of which is closed for thereby allowing the contents to move therein. At the lower side are formed at least two lateral through holes.

At the bottom of the piston rod 320 is provided a sealing cap 321 the outer surface of which comes into close contact with the inner wall of the cylinder 310, for thereby opening and closing the through hole of the lateral side as it is transformed by the pressure of the contents based on the pumping operation of the pumping member 300.

The stem 330 passes through the hollow part 210 of the support member 200 and ascends and descends based on the rotation of the rotation member 500 and has a spring engaging shoulder 331 the center of which is passed through for the contents to move through the same, the inner side of which is engaged to the piston rod 320. The spring engaging shoulder 331 is formed along the outer surface of the top.

In the present invention, at the outer side of the top of the stem 330 protrudes the guide protrusion which moves along the inclined surface formed by the bent portion 520 of the rotation member 500. The guide protrusion 332 is inserted into the vertical guide groove 410 of the ascending and descending guide member 400.

The guide protrusion 332 supported by the elastic force which tends to move in the upward direction of the elastic force during the rotation of the rotation member 500 moves along the inclined surface of the bent portion 520 which is alternately formed in upward and downward directions at the inner side of the rotation member 500. As the bent portion 520 of the guide protrusion 32 is positioned at the top dead point or the bottom dead point of the bent portion 520 during the rotation of the rotation member 500, the stem 330 ascends and descends, so the pumping operation of the pumping member 300 is performed.

Since the guide protrusion 332 is inserted in the vertical guide groove 410, it does not rotate when the rotation member 500 rotates, so it moves only in upward and downward directions.

The elastic member 340 is installed at the bottom of the stem 330 for thereby providing an elastic force in the upward direction, the top of which elastic member is supported by the bottom of the spring engaging shoulder 331, the bottom of which is mounted at the spring mounting part 220 of the support member 200, so it is contracted or recovers based on the ascending and descending movements of the stem 330 for thereby providing an elastic force in upward direction.

It is preferred that the elastic member 340 is installed not coming into contact with the liquid contents outside the cylinder 310 so that the elastic member 340 is not corroded or damaged by liquid contents, and the contents are not spoiled.

The ascending and descending guide member 400 is engaged to the support member 200 for thereby guiding the upward and downward movements of the guide protrusion 332. In the present invention, it is preferred that a vertical guide groove 410 is formed at both side surfaces of the ascending and descending guide member 400 from the top direction to the bottom direction so that the guide protrusion 331 can be inserted.

The vertical guide groove 410 serves to prevent the rotation of the stem 330 during the rotation of the rotation member 500 and to guide the guide protrusion 332 to be move only in the upward and downward directions.

The rotation member 500 is engaged rotatable while surrounding the support member 200 at the top of the container body 100 and has a discharge part 510 so that a discharge means can be engaged to the top for the sake of discharge of contents.

The discharge part 510 is equipped with a discharge means for discharging contents. In the drawings of the present invention, contents are supposed to be discharged through a ball applicator 700. Various kinds of applicators such as brush, rubber tip, etc. with the functions of discharging contents may be used for the same purpose.

In the present invention, at the inner surface of the rotation member 500 is formed a bent portion 520 surrounding the inner surface of the same for thereby guiding the up and down movements of the guide protrusion 332. As shown in FIGS. 6*a*-6*c*, the bent portion 520 is formed alternately upward and downwards at the inner surface of the rotation member 500. When the rotation member 500 rotates, the bent portion 520 formed in the downward direction pressurizes the guide protrusion 332 for thereby allowing the stem 330 to move downward, and the stem 330 moves upward by an elastic force of the elastic member 340 at the position where the bent portion 520 is formed in an upward direction, so the pumping member 300 performs a pumping operation.

At the flat mounting portion of the upper most position of the bent portion 520 formed in the upward direction is formed a fixing protrusion 521 which fixes the guide protrusion 332 for thereby preventing the rotation member 500 from rotating by accident. It is preferred that when the user rotates the rotation member when in use, the rotation start position of the rotation member 500 and the rotation stop position of the same can be recognized by a user's hand tactile sense.

At the inner side of the top of the rotation member 500 is formed an engaging part 530 to which a leak prevention part 600 is engaged for the purpose of preventing the leakage of the contents which move in the upward direction as the engaging part 530 is inserted into the top of the stem 330. At the inner surface of the engaging part 530 is formed a mounting protrusion 531 into which the leakage prevention cap 620 of the leakage prevention part 600 is mounted.

Here the leakage prevention part 600 is inserted into the inner side of the top of the stem 330 for the purpose of guiding the upward movement of the contents and preventing the contents, which are supposed to move in the upward direction, from moving along the inner wall of the stem 330. For this, at the center is formed a content moving hole 611 in a longitudinal direction, which is a passage through which the contents move. The leakage prevention part 600 comprises a leakage prevention rod 610 the bottom of which is formed in a piston shape, and a leakage prevention cap 620 which surrounds the top of the leakage prevention rod 610 and is mounted at the mounting protrusion 531 of the engaging part 530 for thereby supporting the leakage prevention rod 610.

The leakage prevention rod 610 has a piston-shaped bottom and is configured to come into close contact with the inner wall of the stem 330. With this, the contents, which are supposed to move in the upward direction, move along the inner wall of the stem 330 for thereby preventing the leakage.

It is preferred that an over cap 800 is engaged to the top of the rotation member 500 for the purpose of protecting the ball applicator 700 while it surrounds the rotation member 500 in an attempt to block the inputs of impurities.

The operations of the rotary pumping type cosmetic container according to the preferred embodiments of the present invention will be described with reference to FIGS. 1 to 6.

As best seen in FIGS. 1 to 6, in the rotary pumping type cosmetic container according to the present invention, when the rotation member 500 is rotated in one direction or in the other direction in a state that the guide protrusion 332 formed at the stem 330 is fixed at the fixing protrusion 521 of the rotation member 500, the guide protrusion 332 separates from the fixing protrusion 521 and moves in the downward direction along the bent portion 520 and then moves in the upward direction, by which a pumping operation can be performed. At this time, in terms of the upward and downward movements of the guide protrusion 332, the guide protrusion 332 is pressurized and moves in the downward direction by means of the bent portion 520, and then the guide protrusion 332 moves in the upward direction by means of an elastic force of the elastic member 340 at the position where the bent portion 520 is formed in the upward direction.

The present invention has features in that the pumping operations of the pumping member 300 are performed by means of a simple way of using the structure of the bent portion which is alternately formed in upward and downward directions surrounding the inner surface of the rotation member 500 and the rotation member 500 rotated by means of the elastic force of the elastic member 340 for thereby efficiently discharging the contents. As a result, the present invention makes it possible to discharge contents in simple ways irrespective of the directions of rotations.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A rotary pumping type cosmetic container, comprising:

a container body which stores cosmetic contents;

a support member which is engaged to a top of the container body and is hollow and supports a pumping member;

the pumping member which is engaged to the support member and performs the pumping operation for the contents stored in the container body to be discharged outside and comprise:

a cylinder which is engaged to the support member;

a piston rod which ascends or descends in an interior of the cylinder;

a stem which is engaged to the piston rod and has a guide protrusion which protrudes from an outer side of the top; and an elastic member which is installed at a bottom of the stem and provides an elastic force in an upward direction;

an ascending and descending guide member which is engaged to the support member and has a vertical guide groove, into which the guide protrusion is inserted, for thereby preventing a rotation of the stem and guiding the ascending and descending operations;

a rotation member which is engaged rotatable at the top of the container body and surrounds the support member and at the top of the rotation member is formed a discharge potion for discharging the contents, at the inner surface of which is formed a bent portion surrounding the inner surface for thereby guiding the upward and downward movements of the guide protrusion; and a discharge means which is engaged to the discharge portion of the rotation member for thereby discharging the contents.

2. The container of claim 1, wherein the bent portion is alternately formed in upward and downward directions and surrounds the inner surface of the rotation member.

3. The container of claim 1, wherein at a flat mounting portion of the upper most portion of the bent portion formed at the top is provided a fixing protrusion which fixes the guide protrusion.

4. The container of claim 1, wherein to the inner side of the top of the rotation member is engaged a leakage prevention part which is inserted into the top of the stem and prevents leak of the contents which moves in an upward direction.

5. The container of claim 4, wherein the leakage prevention part comprises:

a leakage prevention rod which is inserted into the top of the stem and guides the contents to move in an upward direction, the bottom of the leakage prevention rod coming into close contact with an inner wall of the stem; and a leakage prevention cap which is engaged surrounding the top of the leakage prevention rod and is mounted at the inner side of the top of the rotation member and supports the leakage prevention rod.

6. The container of claim 5, wherein the leakage prevention rod comprises a content moving hole at a central portion in a longitudinal direction, the bottom of the leakage prevention rod being formed in a piston shape and coming into a close contact with an inner wall of the stem.

* * * * *